US011337532B2

(12) United States Patent
Wang et al.

(10) Patent No.: US 11,337,532 B2
(45) Date of Patent: May 24, 2022

(54) HANDLE, COVER AND CUP CAPABLE OF HOLDING ITEMS

(71) Applicant: SHEN ZHEN QUICK FIT PLASTIC CO., LTD., Shenzhen (CN)

(72) Inventors: Qi Wang, Shenzhen (CN); Hui Kang, Shenzhen (CN)

(73) Assignee: SHEN ZHEN QUICK FIT PLASTIC CO., LTD., Shenzhen (CN)

( * ) Notice: Subject to any disclaimer, the term of this patent is extended or adjusted under 35 U.S.C. 154(b) by 153 days.

(21) Appl. No.: 16/931,412

(22) Filed: Jul. 16, 2020

(65) Prior Publication Data

US 2021/0161319 A1 Jun. 3, 2021

(30) Foreign Application Priority Data

Nov. 29, 2019 (CN) ..... 201922120054.2

(51) Int. Cl.
*B65D 23/10* (2006.01)
*A47G 19/22* (2006.01)

(52) U.S. Cl.
CPC ..... *A47G 19/2205* (2013.01)

(58) Field of Classification Search
CPC .... B65D 23/10; B65D 23/102; B65D 23/104; B65D 23/106; B65D 23/108; B65D 2525/28; B65D 2525/289; A47G 19/2205
USPC ..... 220/212.5; 294/34, 31.2
See application file for complete search history.

(56) References Cited

U.S. PATENT DOCUMENTS

| | | | | |
|---|---|---|---|---|
| 5,667,265 | A * | 9/1997 | Gebhard | B65D 23/108 294/169 |
| 7,802,697 | B2 * | 9/2010 | Martin | A47B 73/008 221/165 |
| 8,746,498 | B2 * | 6/2014 | Maldonado | A45F 5/02 220/756 |
| 9,723,939 | B2 | 8/2017 | Wharton | |
| 2013/0193198 | A1 | 8/2013 | Byun | |
| 2017/0273483 | A1 | 9/2017 | McArthur | |

FOREIGN PATENT DOCUMENTS

| | | |
|---|---|---|
| CN | 205866540 U | 1/2017 |
| CN | 207768165 U | 8/2018 |

* cited by examiner

*Primary Examiner* — King M Chu

(57) ABSTRACT

A handle, a cover, and a cup capable of holding items are provided in the embodiments of the present disclosure. The handle includes a hard handle body connected with a carrier, and at least one carrying notches provided on the handle body, and the carrying, notch has a width to hold or support the held item. In the embodiments of the present disclosure, the handle with notches can be used as a handle as well as a stand at the same time to support, other items to be held at a predetermined angle, in addition the function of the carrier is further expanded.

6 Claims, 14 Drawing Sheets

HANDLE, COVER AND CUP CAPABLE OF HOLDING ITEMS

CROSS-REFERENCE TO RELATED APPLICATIONS

This application claims priority to Chinese Patent Application No. 201922120054.2 with a filing date of Nov. 29, 2019. The content of the aforementioned applications, including any intervening amendments thereto, are incorporated herein by reference.

TECHNICAL FIELD

The present disclosure relates to the technical field of daily necessities, in particular to a handle, a cover and a cup capable of holding items.

BACKGROUND OF THE PRESENT INVENTION

The background technology probably related to various aspects of the embodiments of the present disclosure is introduced to readers in this section, in order to provide readers with useful background information, thereby helping readers to better understand various aspects of the embodiments of the present disclosure. Therefore, it should be understood that the description in this section is for the above purpose but does not constitute an admission of the prior art.

With the changes of modern life, people's productions and lives are inseparable from electronic products such as mobile phones. So smart phones, tablet computers and other electronic products are more and more favored by consumers, and are more and more held by consumers. Holders can go online, chat, watch videos, take selfies, or perform live entertainment through electronic, products such as smartphones and tablets anytime and anywhere. When carrying out these activities, the holder need to locate the smartphone or the tablet computer on a certain place and adjust it to a suitable position and angle. If the mobile phone is held at a lower position, the cervical spine of the user will be immensely injured in the process of using it in this way. Therefore, when the user is sitting at a computer desk or desk and using the mobile phone for entertainment, the best way is to make the mobile phone be aslant supported, so that the display screen of the mobile phone and the user's line of sight have a reasonable tilt angle. To this end, a series of mobile phone and tablet stands have been set up, but these designs are independent designs. Once you forget to carry these stands, there is no way to support electronic devices such as mobile phones or tablets. These stands have not been innovated on the basis of the existing technology, to make the existing equipment exert the maximum function.

Cup is one of the most important drinking tools in daily life. When people participate in physical exercise, they usually carry a cup to drink water when they are thirsty or to dissolve nutrients in water to supplement nutrition. For example, we can design a kind of electronic equipment stand on the cup or similar utensils that we usually use, so that the water cup or utensil can also have other functions in the realization of its most basic functions, for example, it can be a device for fixing mobile phone or tablet.

SUMMARY OF PRESENT INVENTION

The technical problem to be solved is how to provide a handle for holding items.

In view of the shortcomings in the prior art, a handle, a cover and a cup capable of holding items are provided in the embodiments of the present disclosure, which can be used as a handle and can also be used as a stand.

In the first aspect, a handle capable of holding items is provided in the embodiment of the present disclosure, comprising:

a hard handle body, the handle body is connected to a carrier; the handle body is provided with at least one carrying notch; the carrying notch has a width to hold or support the held item.

Optionally, it also comprises:

a rotary connection device, the handle body is connected to the carrier through the rotary connection device:

the rotary connection device comprises:

a rotary shaft, the rotary shaft is provided on the carrier or the handle body; the handle body is rotatably connected to the carrier through the rotary shaft;

a limiting device, the limiting device is provided on the carrier or the handle body;

the limiting device is used to limit the rotation angle of the handle body.

Optionally, the limiting device comprises:

a limiting protrusion provided on the carrier and a limiting engagement surface provided on the handle body for matching with the limiting protrusion; or, a limiting protrusion provided on the handle body and a limiting engagement surface provided on the carrier for matching with the limiting protrusion;

when the handle body is rotated to a predetermined position, the limiting protrusion comes into contact with the limiting engagement surface, restricting the handle body from further rotation.

Optionally, the protrusion is a prism, and the cross section of the prism, is a trapezoid or triangle.

Optionally, the base angle of the trapezoid or triangle is 56°-77°.

Optionally, the notches are provided on both sides of the handle body.

Optionally, the width of the notch is 0.5-3 cm.

In the second aspect, a cover is also, provided in the present disclosure, which comprises the above-mentioned handle capable of holding items, and the cover is covered on the carrier.

In the third aspect, a cup is also provided in the present disclosure, the cup comprises the above-mentioned-cover.

In the fourth aspect, a cup is also provided in the present disclosure, the cup, comprises the above-mentioned handle capable of holding items.

It can be seen from the above technical solutions that the handle, cover and cup capable of holding items provided in the embodiments of the present disclosure can not only stave as a handle but also serve as a stand through the notch provided on the handle at the same time, to support other objects held at a predetermined angle, and in addition, the function of the carrier is further expanded.

DESCRIPTION OF THE DRAWINGS

In order to explain the embodiments of the present disclosure or the technical solutions in the prior art more clearly, a brief introduction to the drawings needed in the description of the embodiments or the prior art will be given in the following. Obviously, the drawings in the following description are only some embodiments of the present disclosure, other drawings can also be obtained by those skilled in the art based on these drawings without creative labor.

DETAILED DESCRIPTION OF PREFERRED EMBODIMENTS

Figure 1:
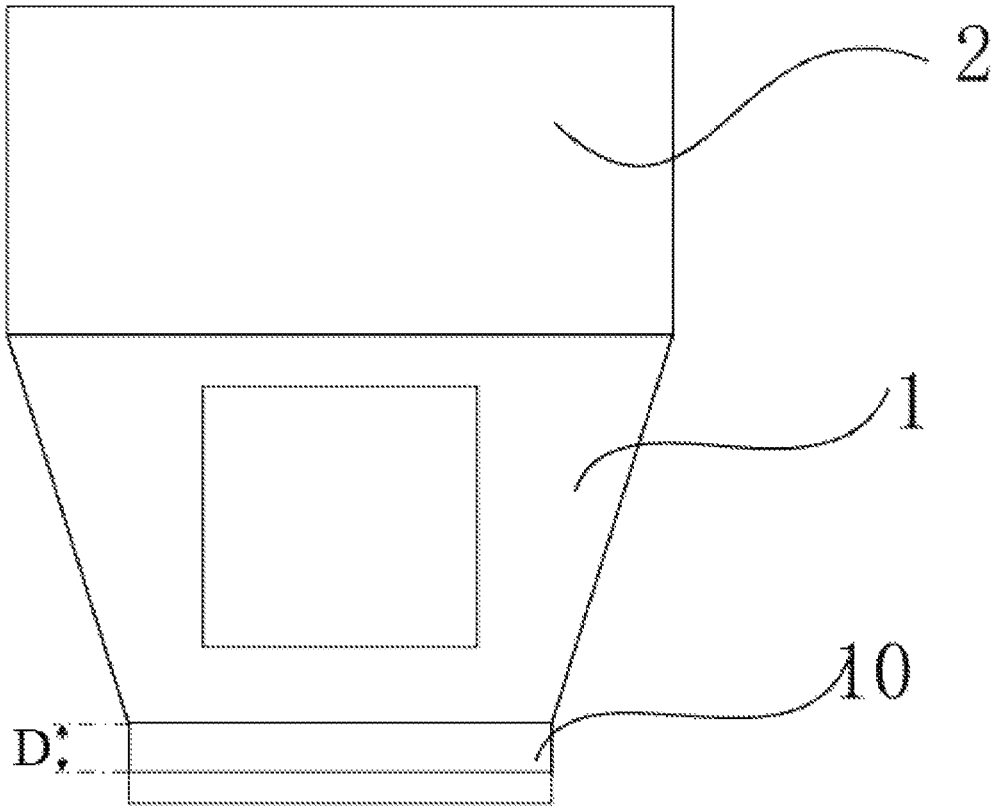
FIG. 1 is a top view of a handle capable of holding items in an embodiment of the present disclosure.
Figure 2:
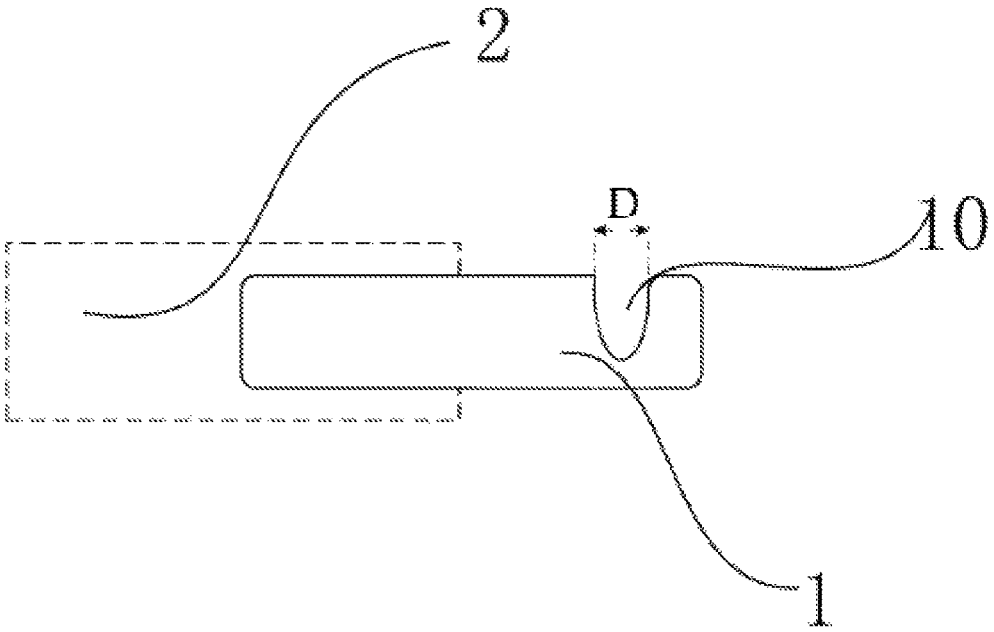
FIG. 2 is a side view of a handle capable of holding items in another embodiment of the present disclosure.

In order to make the purpose, technical solutions and advantages of the embodiments of the present disclosure more clear, the technical solutions in the embodiments of the present disclosure will be described clearly and completely in conjunction with the drawings in the embodiments of the present disclosure. Obviously, the described embodiments are only part of the embodiments of the present disclosure, but not all of them. Based on the embodiments in the present disclosure, all other embodiments obtained by the skilled in the art without making creative efforts will fall within the scope of the present disclosure.

Referring to FIG. 1 to FIG. 6, a handle capable of holding items is provided in the embodiment of the present disclosure, including: a hard handle body 1, the handle body 1 and a carrier 2 are connected; the handle body 1 is provided with at least one carrying notches 10, the carrying notch 10 has a width D for holding or supporting the held item 3. The handle capable of holding items provided in the embodiment of the present disclosure will be described in detail below.

Figure 3:
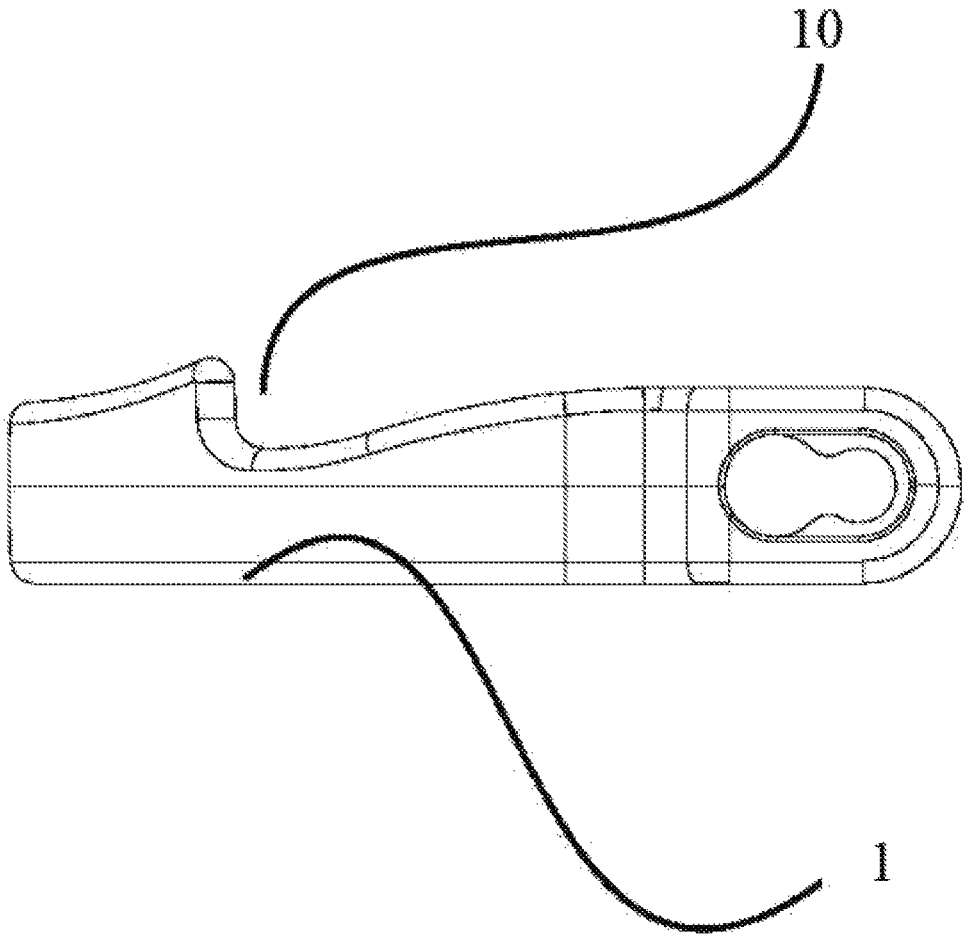
FIG. 3 is a side view of a handle capable of holding items in another embodiment of the present disclosure.
Figure 4:
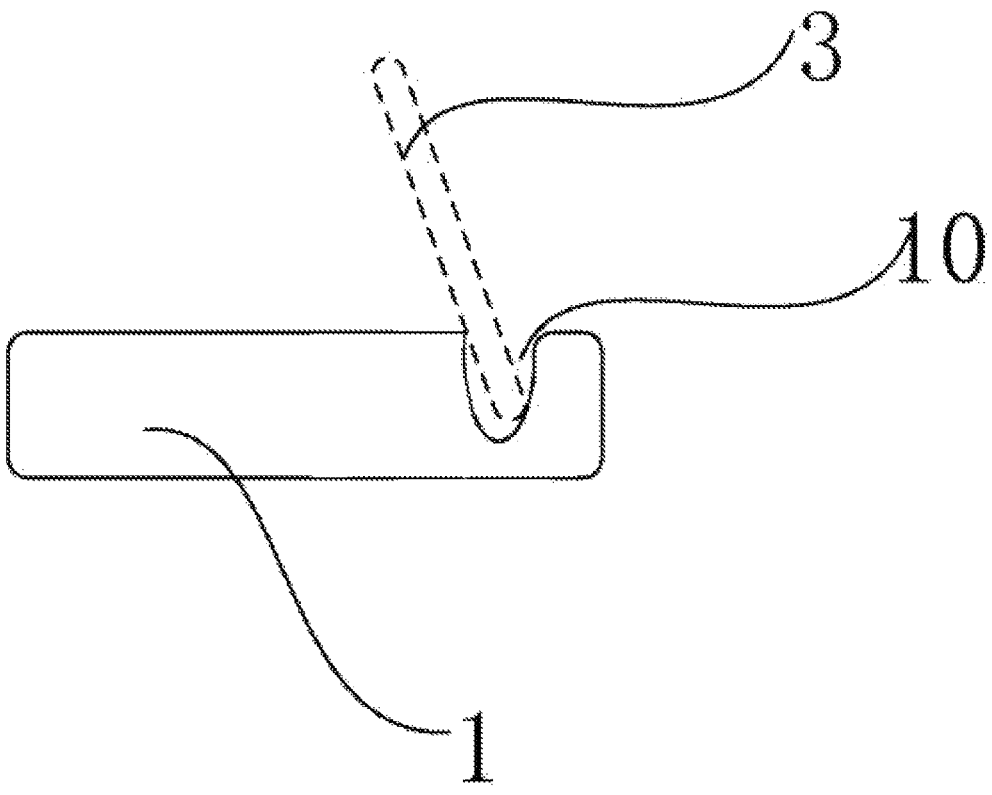
FIG. 4 is a schematic diagram of the structure of the handle body of a handle capable of holding items in the embodiment shown in FIG. 2 when in use.
Figure 5:
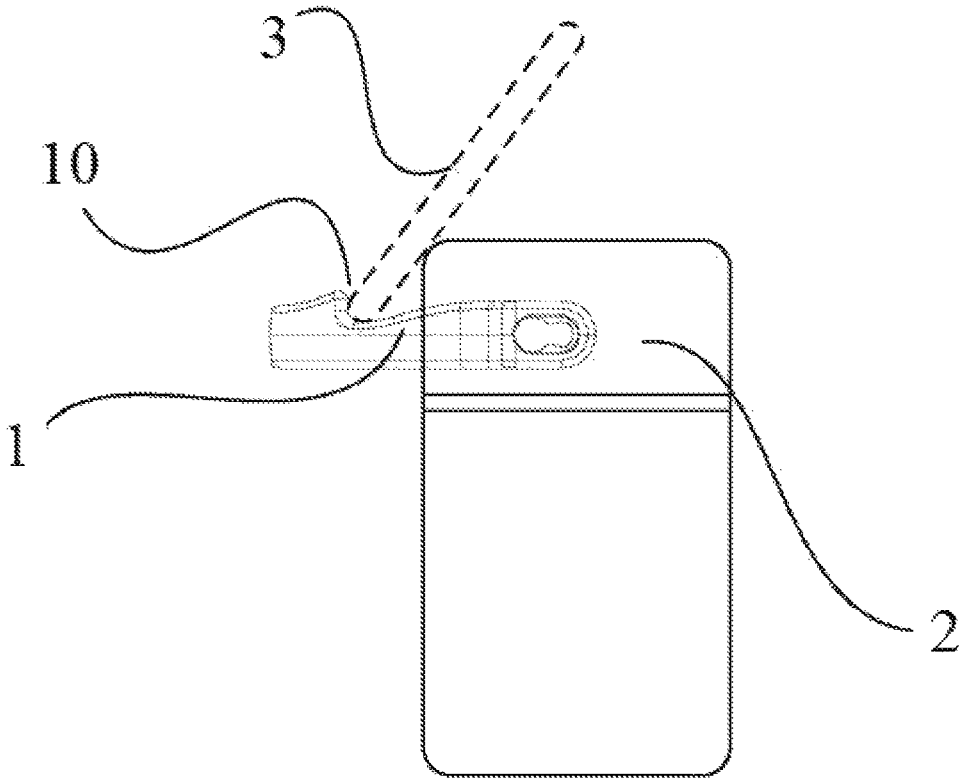
FIG. 5 is a schematic diagram of the structure of the handle body of a handle capable of holding items in the embodiment shown in FIG. 3 when in use.
Figure 6:
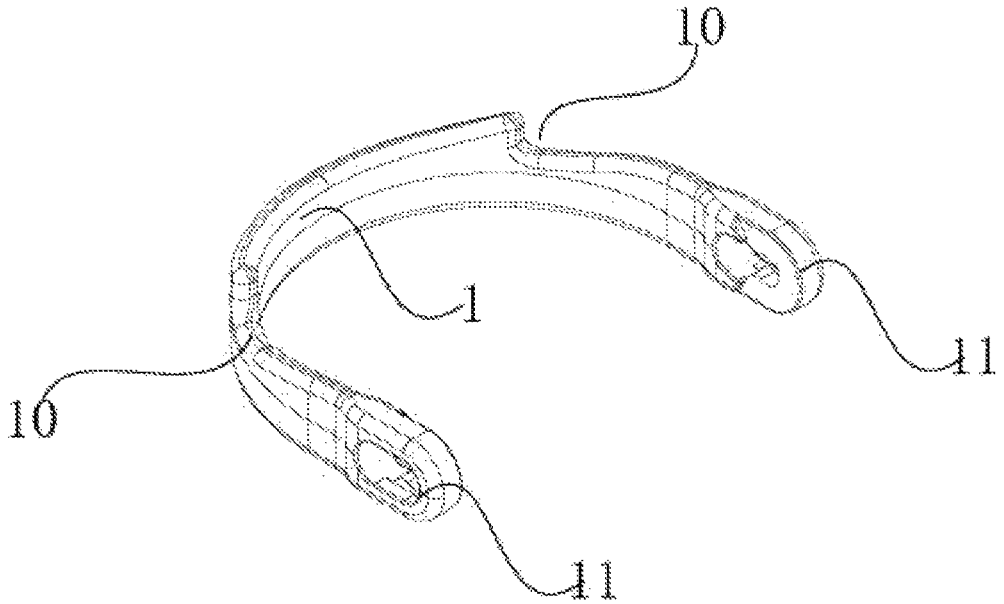
FIG. 6 is a schematic diagram of the overall structure of a handle capable of holding items in, another embodiment of the present disclosure.

In the embodiment of the present disclosure, as shown in FIG. 1 to FIG. 5, the handle body 1 is made of hard material to ensure sufficient support force when items being held to avoid its deformation, and further effectively ensure its stable connection with the carrier 2. In the present, disclosure, the carrier may be one or more notches 10 provided on the handle body to ensure stable support for the item 3 held, and the notch 10 has a sufficiently wide width D and a sufficiently deep depth H to easily clamp or stably support the item 3 held in the notch. The width D of the notch can be selected from 0.5-3 cm, the item can be held as long as its thickness is less than the width. As shown in FIG. 1 and FIG. 4, when the handle body 1 is a plate, it is directly fixed on the carrier 2. If a notch 10 is provided on the handle body 1, the width and depth of the notch 10 need to be wide and deep enough. When the item 3 is held into the notch, there must be at least two, points or positions supporting or clamping the held item 3 to make the item held stable and not slip. As shown in FIG. 5, the contact position of the notch 10 can also be used as the support point to form a plurality of point supports with the carrier 2, to stably support the held item 3. Further, as shown in FIG. 3, FIG. 5, and FIG. 6, when the handle body 1 is a bar or a ribbon, the two ends 11 of the handle body 1 are connected to the carrier 2, and the notch 10 is provided near the middle of the handle body 1. In order to ensure effective and stable support for the held item 3, at least two notches 10 are provided. The contact position of the two notches 10 is used as a support point to form a plurality of point supports with the carrier 2 to stably support the held item 3. The item can be held as long as its length is equal to or larger than the width between the notches 10 provided at both ends, and its thickness is less than the width of the notch 10. In the embodiment of the present disclosure, the carrier 2 may be a cup, a suitcase, a mobile power supply, a storage box, a lunch box, etc. Of course, it may also be a part of the above objects, such as a cover of a cup, a base of a power supply, and the like. It should be understood that the embodiments of the present disclosure are not limited to these, and other load-carrying devices with handles that can cooperate with the handles capable of holding items provided in the present disclosure to support and place items can be implemented. In the embodiment of the present disclosure, the held item 3 can be selected from existing mobile phones, tablet computers, keyboards and other objects or ornaments that need to be supported at a predetermined angle. Of course, it should be understood that the present disclosure is not limited to these, and other items suitable for being held on the handle capable of holding items may also be implemented, such as documents, etc., and will not be listed here one by one.

Figure 7:
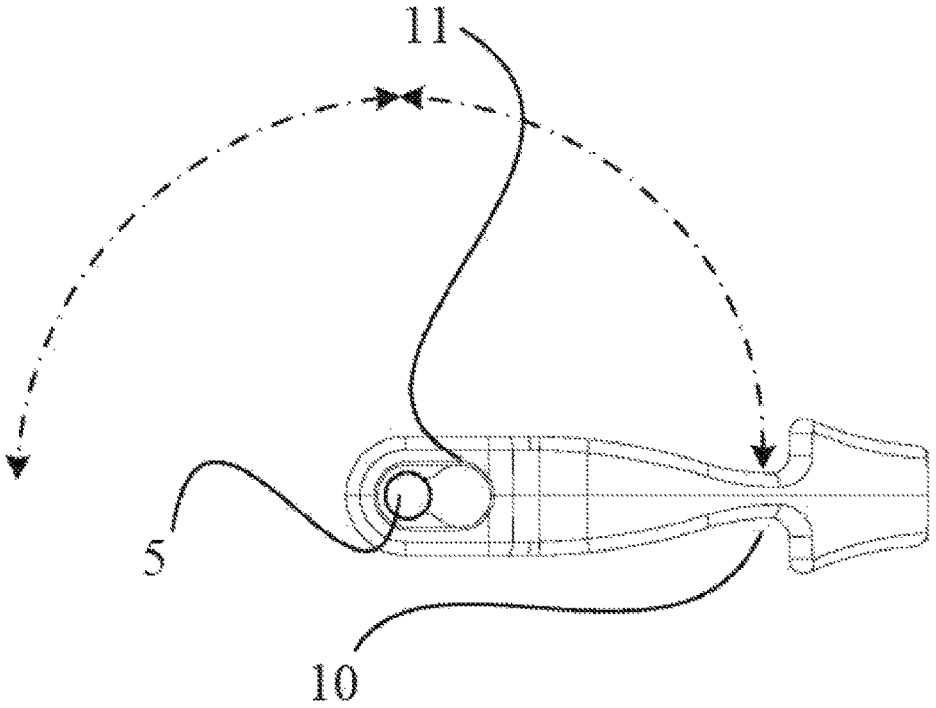
FIG. 7 is a schematic diagram of the overall structure of a handle capable of holding items in another embodiment of the present disclosure.
Figure 8:
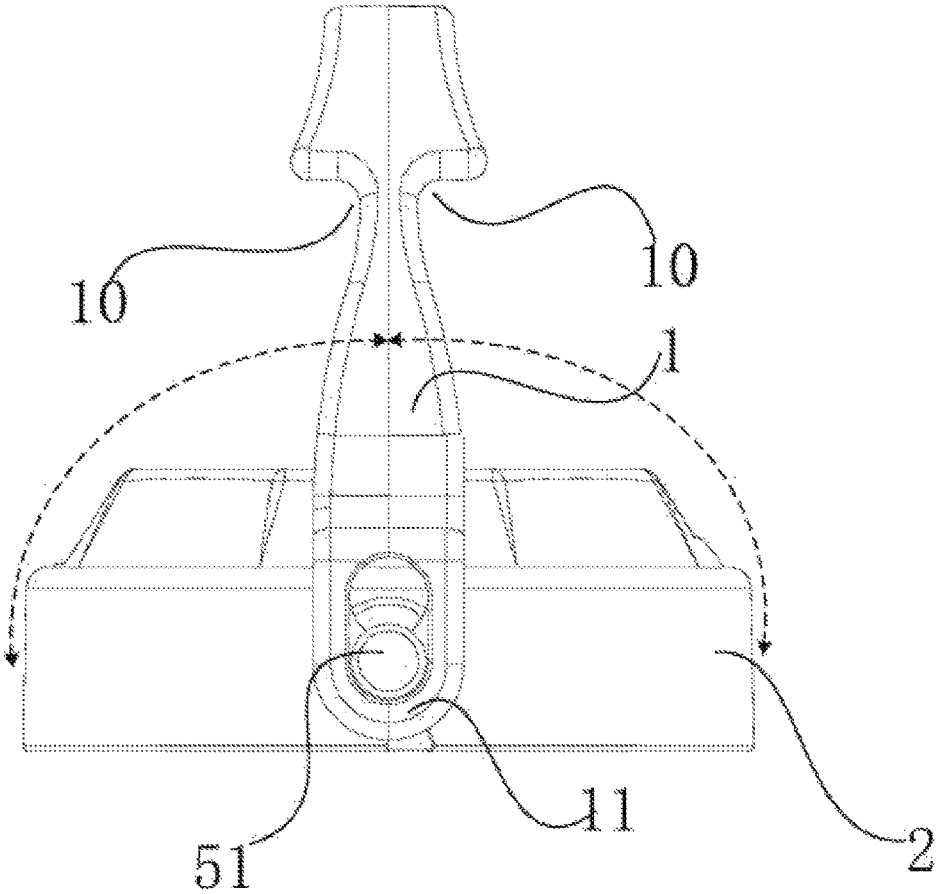
FIG. 8 is a schematic diagram of the structure of the handle body in the embodiment shown in FIG. 7 when in use.
Figure 9:
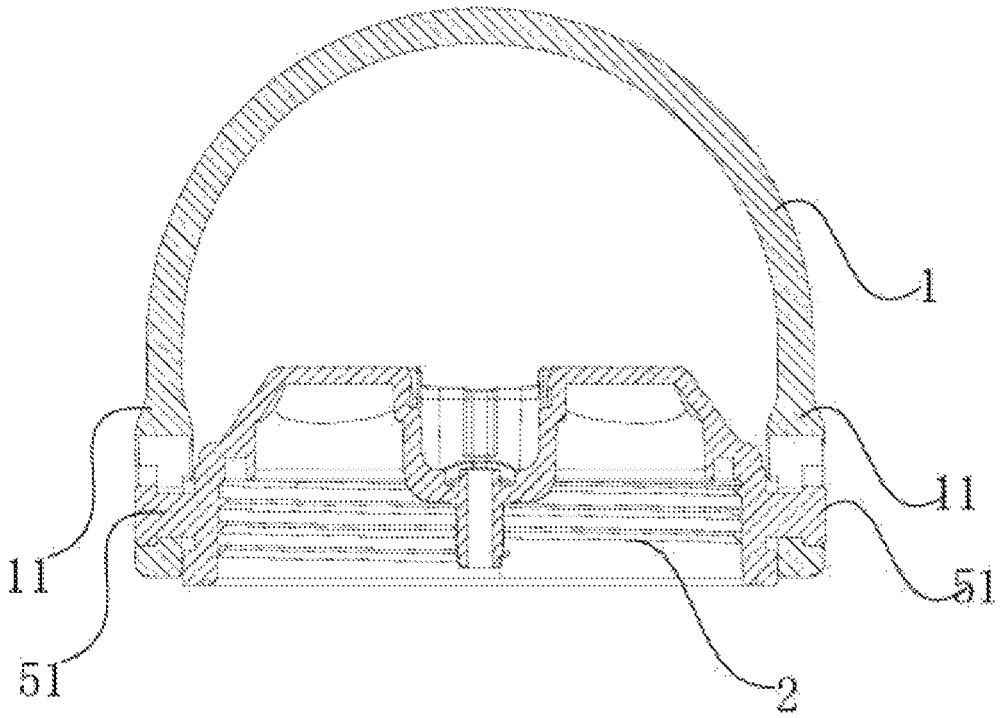
FIG. 9 is a cross-sectional view of the handle capable of holding items in the embodiment shown in FIG. 7.
Figure 10:
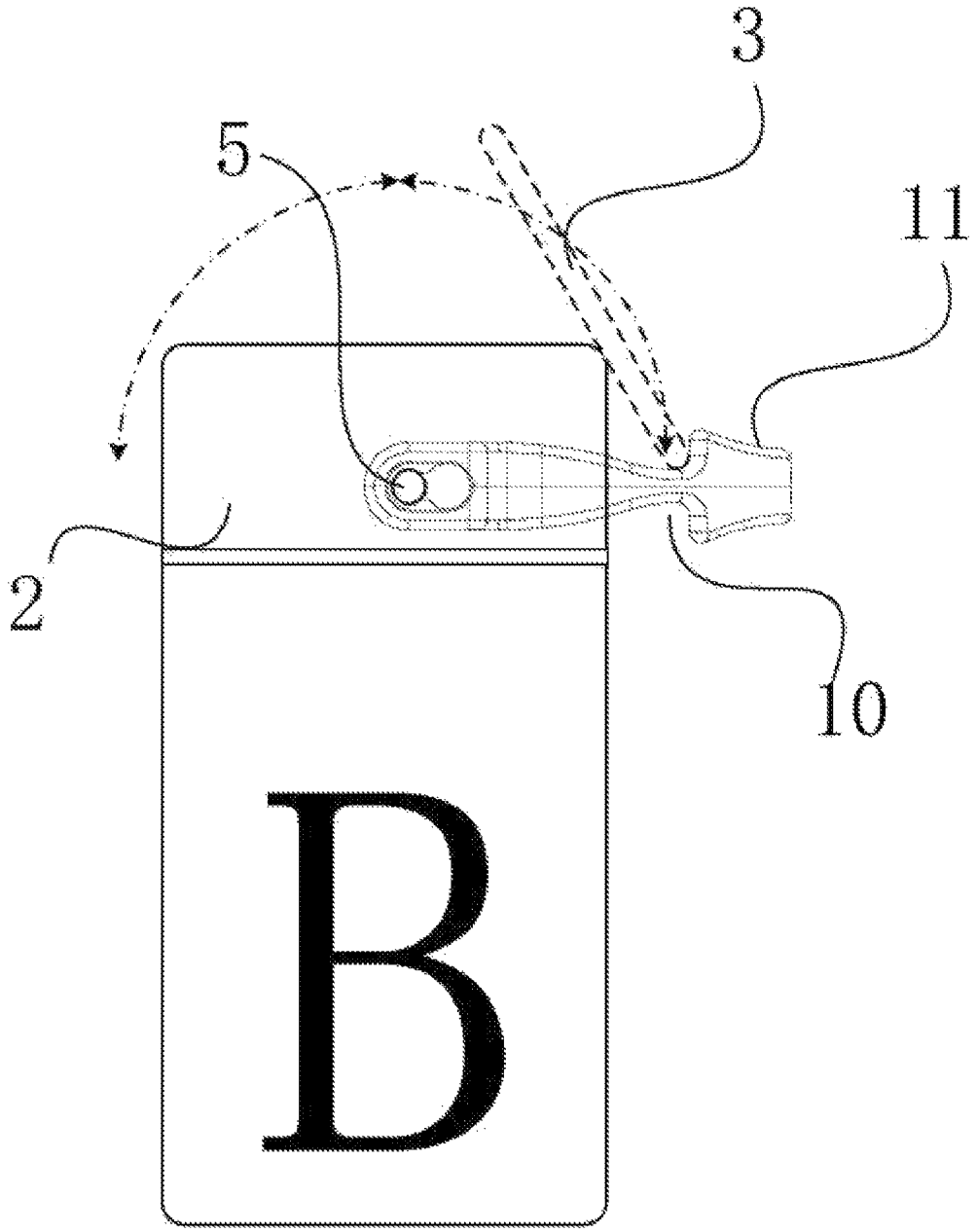
FIG. 10 is a schematic diagram of the structure of the handle body of a handle capable of holding items in an embodiment of the present disclosure.
Figure 11:
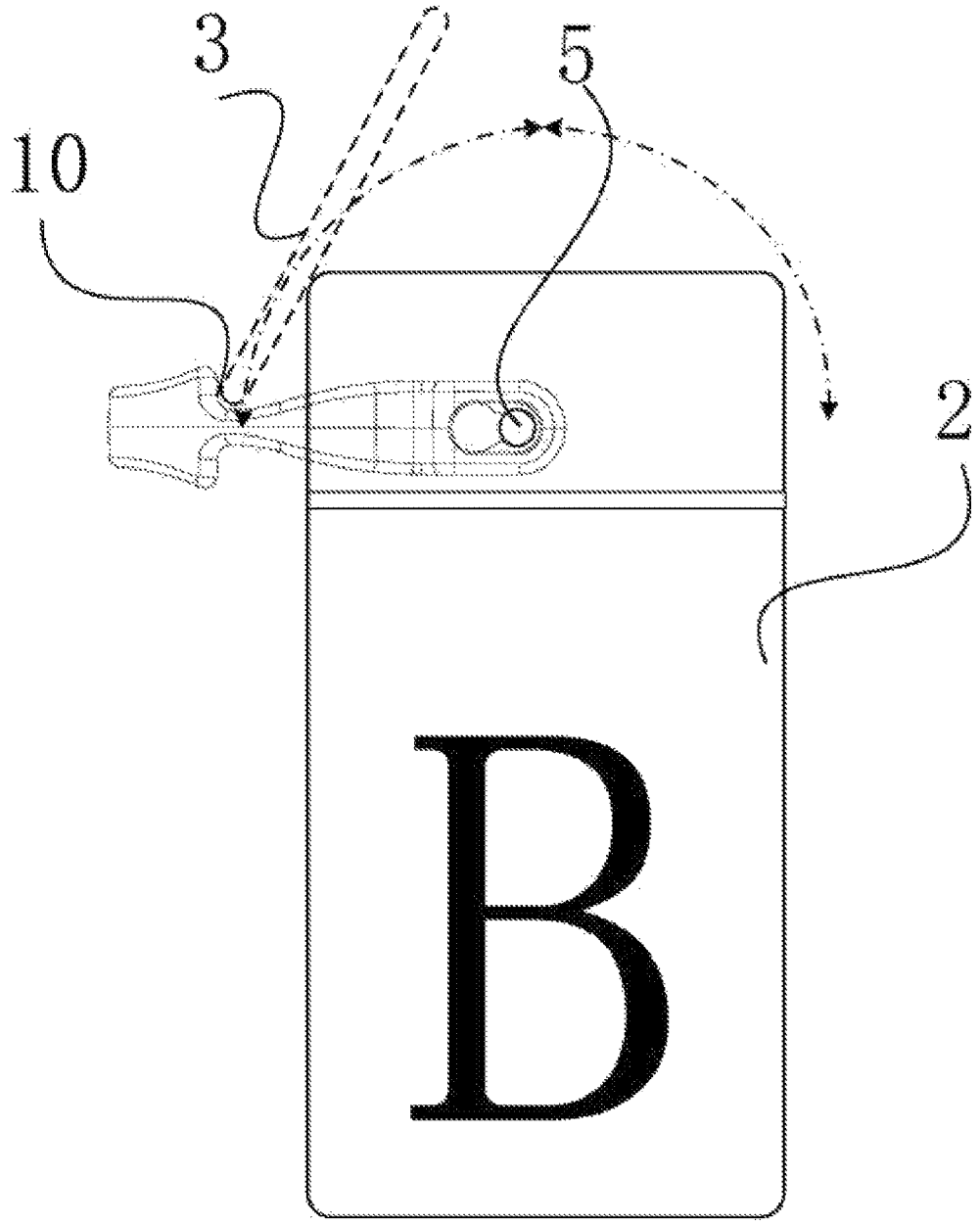
FIG. 11 is a schematic diagram of the structure of the handle body of a handle capable of holding items in an embodiment of the present disclosure.

In order to facilitate to adjust the handle capable of holding items provided in the present disclosure to any angle, and avoid the need to rotate the carrier 2 to a specific position to place a mobile phone or tablet, the handle body 1 is set to be rotatable in the embodiment of the present disclosure. As shown in FIG. 7 to FIG. 9, the handle capable of holding items further includes a rotary connection device 5 through which the handle body 1 is rotatably connected to the carrier 2. The rotary connection device 5 includes: a rotating shaft 51 provided on the carrier 2 or the handle body 1, the handle body 1 is rotatably connected to the carrier 2 through the rotating shaft 51; a limiting device (not shown in the figures) provided on the carrier 2 or the handle body 1, the limiting device is used to limit the rotation angle of the handle body 1. Through the limiting device, the case of difficultly holding the item due to the lack of rotation or excessive rotation of the handle body 1 can be effectively avoided. Further, it is possible to provide notches 10 on both sides of the handle body 1. The handle capable of holding items provided in the present disclosure can be used to support the mobile phone in the state shown in FIG. 10 or in the state shown in FIG. 11, without turning or adjusting the position of the carrier 2.

Figure 12:
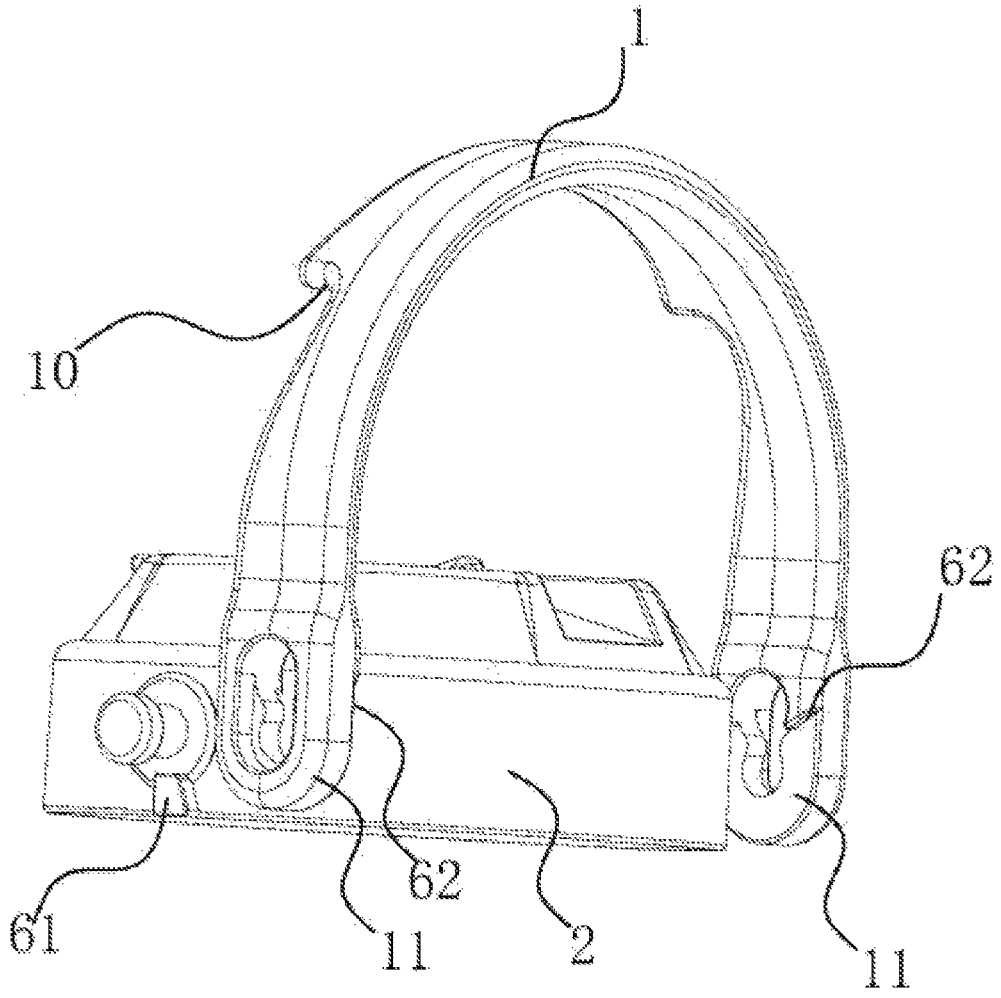
FIG. 12 is an exploded view of the structure of a limiting device of a handle capable of holding items in an embodiment of the present disclosure.
Figure 13A:
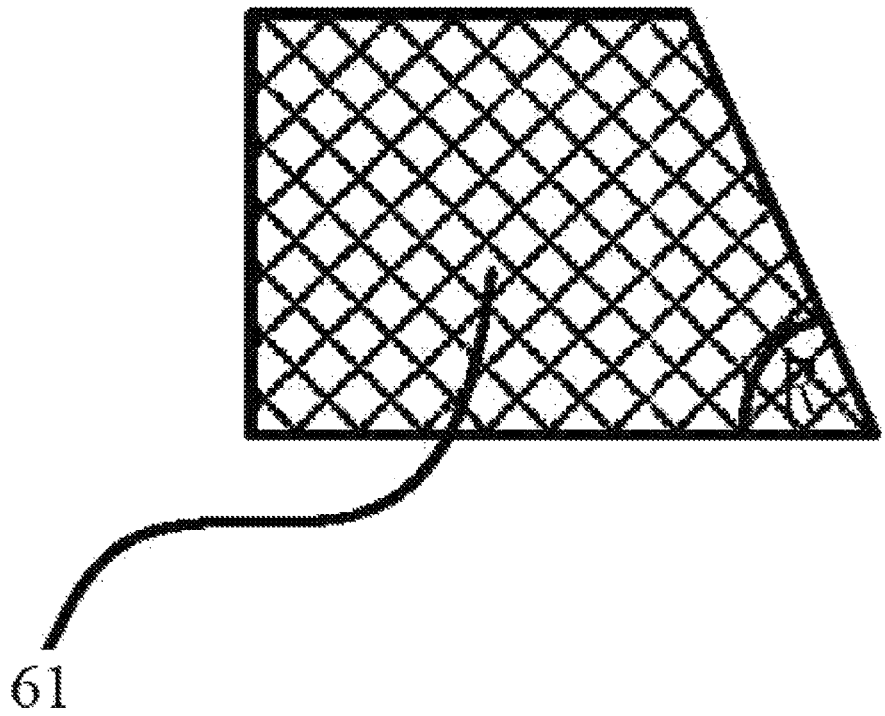
FIG. 13A, FIG. 13B, and FIG. 13C are cross-sectional views of the structures of the limiting protrusions in an embodiment of the present disclosure.
Figure 13B:
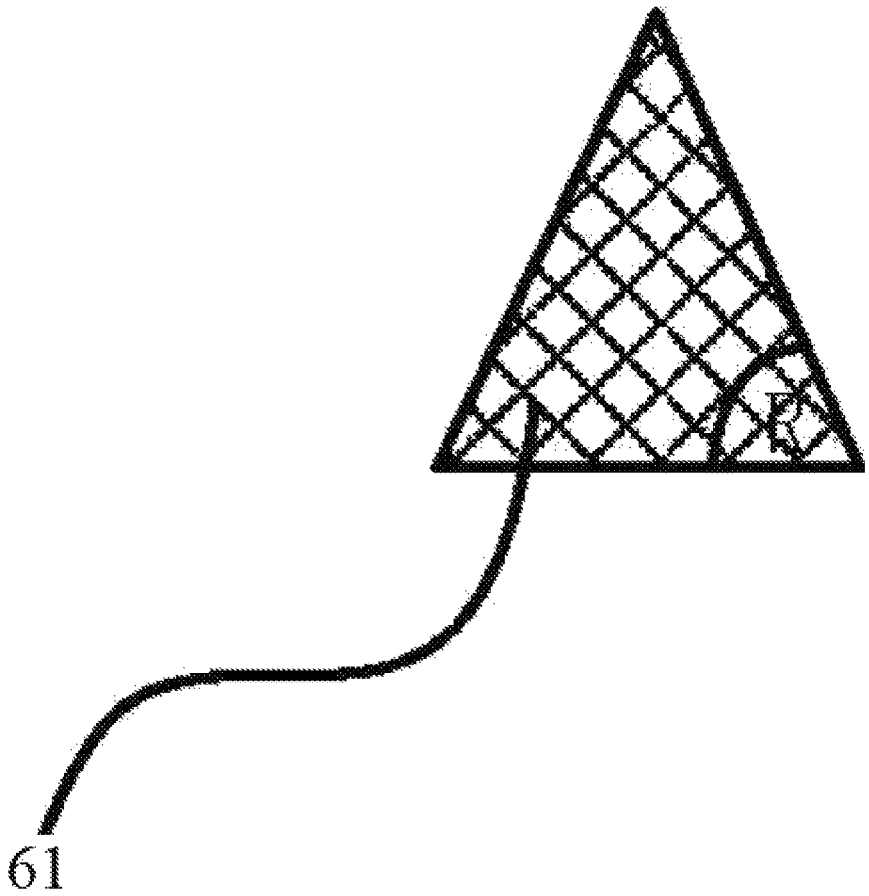
Figure 13C:
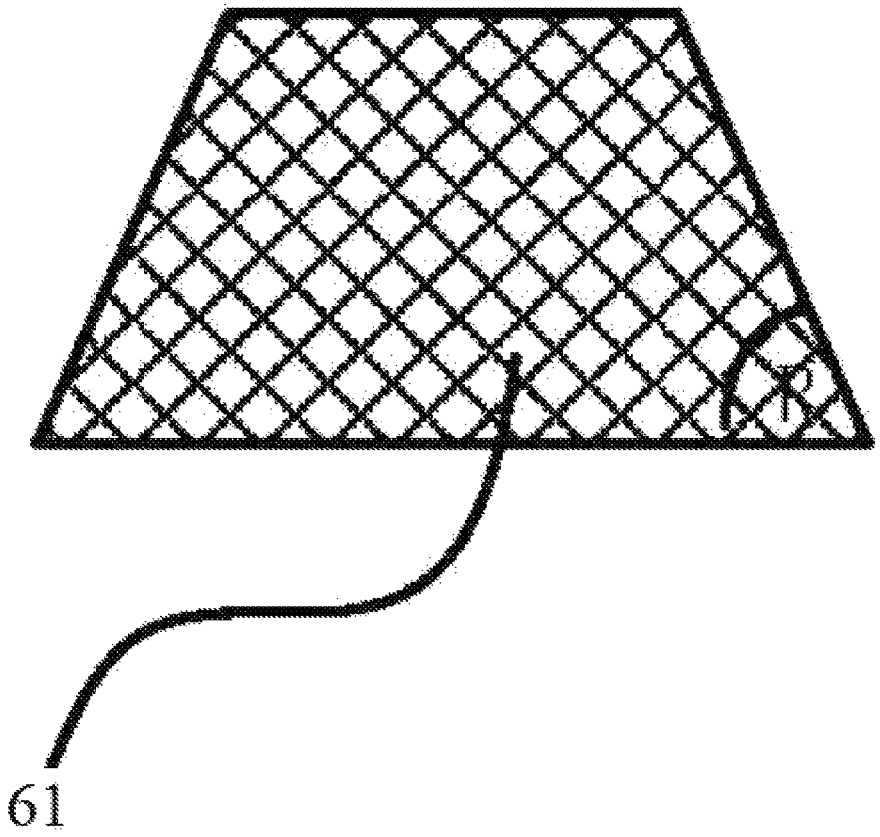

In the embodiment of the present disclosure, the limiting device may be optionally provided at a position where each end 11 of the handle body 1 is connected to the carrier. As shown in FIG. 12, the limiting device includes a limiting protrusion 61 provided on the carrier and a limiting engagement surface 62 provided on the handle body which is matched with the limiting protrusion 61, or a limiting protrusion provided on the handle body and a limiting engagement surface provided on the carrier which is matched with the limiting protrusion. When the handle body 1 is rotated to a predetermined position, the limiting protrusion 61 is in contact with the limiting engagement surface 62 to restrict the handle body 1 from further rotation. The surface contact formed between the limiting projection 61 and the limiting engagement surface 62 can make the rotation of the handle body 1 stopped at a predetermined rotation angle more stable, avoiding the case of difficultly holding the item due to the lack of rotation or excessive rotation. As shown in FIG. 11 and FIG. 13A to FIG. 13C, the limiting protrusion 61 may be a prism, and the cross section of the prism is a trapezoid or triangle. Further, the base angle R of the trapezoid or triangle is 56°-77°. For example, when the base angle is set to 56°, the rotation of the handle body 1 may be stopped at an angle of 124°. When the base angle is set to 77°, the rotation of the handle body 1 may be stopped at an angle of 103°.

Figure 14:
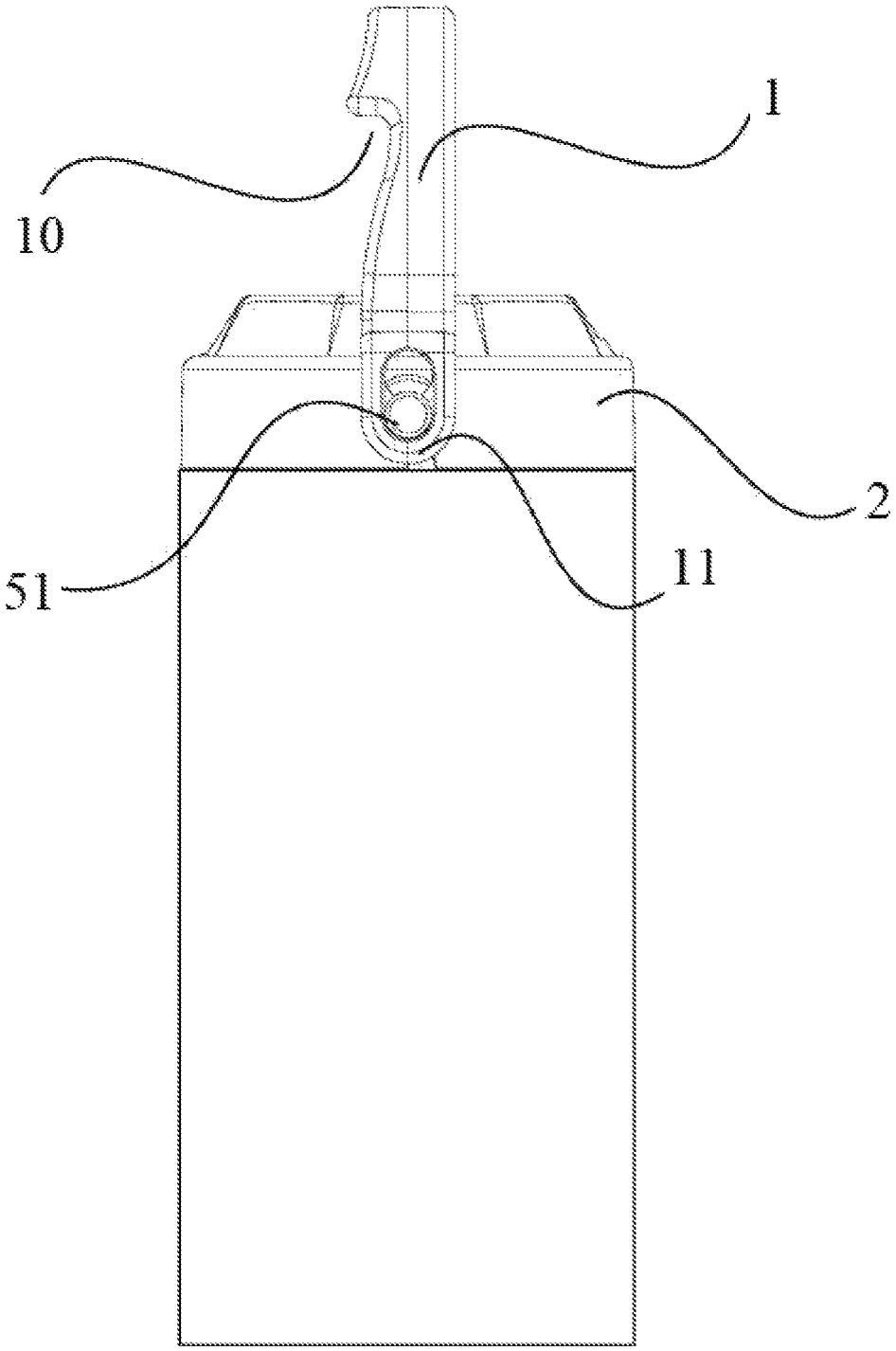
FIG. 14 is a schematic diagram of the overall structures of a cover and a cup in an embodiment of the present disclosure.

To further exemplify the superiority of a handle capable of holding items provided in the present disclosure a cover is also provided in the present disclosure, as shown in FIG. 14, the cover includes one of the above handles capable of holding items, the cover is covered on the carrier. In the embodiment of the present disclosure, the cover may be a cover of a cup cover, a cover of a lunch box, or a cover of other objects. When the cover is covered on a carrier such as a cup, the cover and the carrier will jointly support a handle capable of holding items, to further support the held item such as the mobile phone on the handle. Further, a cup is also provided in an embodiment of the present disclosure, and the cup includes the above-mentioned cover.

Figure 15:
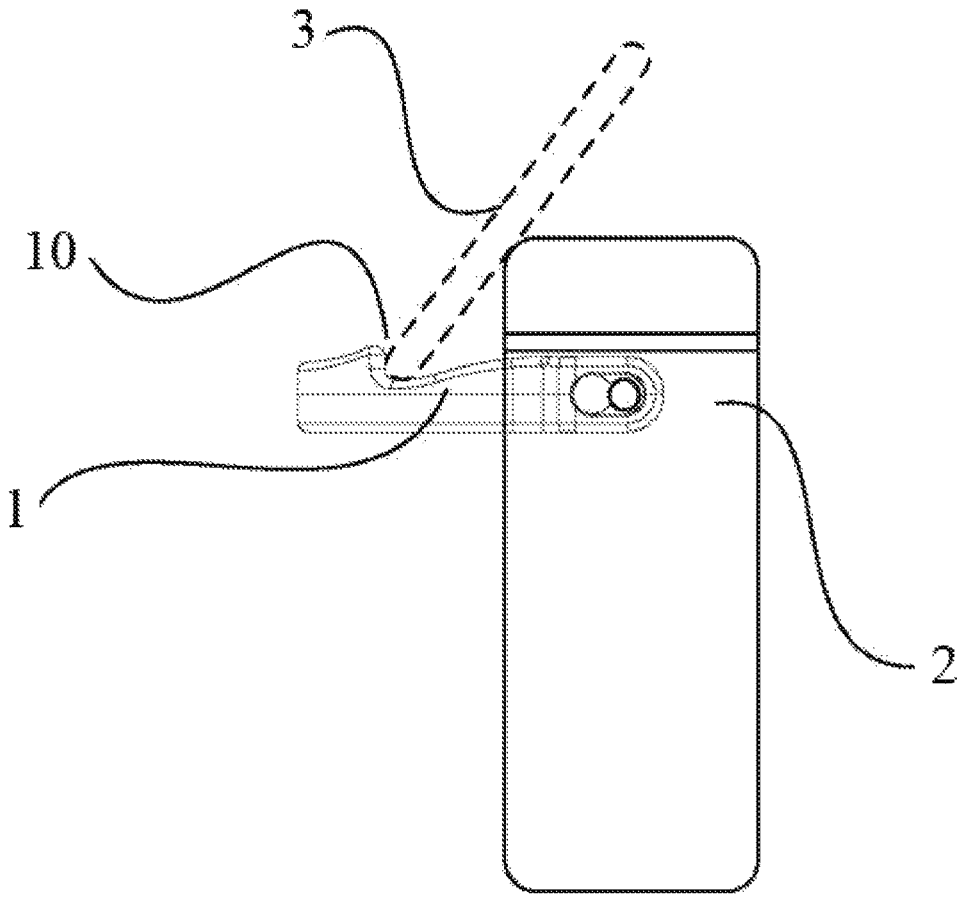
FIG. 15 is a schematic diagram of the overall structure of a cup in an embodiment of the present disclosure.

To further exemplify the superiority of the handle capable of holding items, provided in the present disclosure, a cup is also provided in the present disclosure, the cup includes the above-mentioned handle capable of holding items. As shown in FIG. 15, the handle capable of holding items provided in the present disclosure can be directly fixed on the body of the cup. The handle body 1 and the cup together form multiple point supports to stably support the held items. Obviously, it should be understood that the handle capable of holding items provided in the embodiments of the present disclosure can also be provided on a cup bag or a cup sleeve. After the cup is put into the cup bag, the handle body 1 and the cup together form a plurality of point supports to stably support the held items.

In summary; except the original usages, the handles, covers and cups capable of holding items provided in the embodiments of the present disclosure can also be used as stands to support other items held at a predetermined angle through the notches provided on the handles, thus further expanding the functions of the carriers.

Finally, it should be understood that, in the description of the present disclosure, the terms used to indicate the azimuth or positional relationship, such as "center", "longitudinal", "transverse", "length", "width", "thickness", ""up", "down", "front", "back", "left", "right", "vertical", "horizontal", "top", "bottom", "inner", "outer", "clockwise"", "counterclockwise", "axial", "radial", "circumferential", etc., are based on the azimuth or positional relationship shown in the drawings. They are only used to facilitate and simplify the description of the present disclosure, but not indicate or imply that the device or element referred to must have a specific orientation, be constructed and operated in a specific orientation, and therefore cannot be construed as limitations to the present disclosure.

In addition, relational terms such as "first", "second", etc. are only used to distinguish one entity or operation from another entity or operation, but not necessarily require or imply that there is any such actual relationship or order between these entities or operations, or it cannot be understood as indicating or implying relative importance, or implicitly indicating the number of indicated technical features. Thus, the features defined as "first" and "second" may include at least one of the features explicitly or implicitly. In the description of the present disclosure, "multiple" means at least two, such as two, three, etc., unless otherwise specifically limited. Moreover, the terms "comprise", "include" or any other variant are intended to cover non-exclusive inclusions, so that a process, method, item or device that includes a series of elements includes not only those elements, but also includes those not explicitly listed, or includes other elements that are inherent to this process, method, item, or device. Without more restrictions, the element defined by the sentence "include one . . . " does not exclude that there are other identical elements in the process, method, item or device that includes the element. Unless otherwise clearly specified and defined, the terms "installation", "connected", "connection", and "fixed" should be understood in a broad sense, for example, it can be a fixed connection, a detachable connection, or an integral connection; it can be a mechanical connection, an electrical connection or a mutual communication; it can be directly connected or indirectly connected through an intermediary, or it can be an internally interaction connection between two elements, unless otherwise clearly defined. For those skilled in the art, the specific meanings of the above terms in the present disclosure can be understood according to specific situations.

There are a lot of specific details in the specification of the present disclosure. However, it should be understood that the embodiments of the present disclosure can be implemented without these specific details. In the description of the specification, the referring terms "one embodiment", "some embodiments", "examples" "specific examples", or "some examples" means that the specific features structures, materials or characteristics described in conjunction with the embodiments or examples are included in at least one of the embodiments or examples of the present disclosure. In some instances, well-known methods, structures, and techniques have not been shown in detail so as not to obscure the understanding of this description. Similarly, it should be understood that in order to simplify the present disclosure and help to understand one or more of the various aspects of the present disclosure, in the above description of the exemplary embodiments of the present disclosure, the various features of the present disclosure are sometimes grouped together into a single embodiment, figure, or description thereof. However, the disclosed method should not be interpreted to reflect the intention that, the claimed disclosure claims more features than those explicitly recited in each claim. Rather, as reflected in the claims, aspects of the present disclosure are less than all features of the single embodiment disclosed above. Therefore, the claims that follow the specific embodiments are hereby explicitly incorporated into the specific embodiments, where each claim itself serves as a separate embodiment of the present disclosure. In this specification, the schematic representation of the above terms does not necessarily refer to the same embodiment or example. It should be noted that the embodiments in this application and the specific features, structures, materials, or characteristics described in the embodiments can be combined with teach other without conflict or contradiction. The present disclosure is not limited to any single aspect, nor to any single embodiment, nor to any combination and/or substitution of these aspects and/or embodiments. In addition, without contradicting each other, those skilled in the art may use each aspect and/or embodiment of the present disclosure alone or in combination with one or more other aspects and/or embodiments thereof.

In the end, it should be noted that the above embodiments are only used to illustrate the technical solution of the present disclosure, but not to limit it. Although the present disclosure has been described in detail with reference to the foregoing embodiments, it should be understood by the skilled in the art that, the technical solutions described in the foregoing embodiments can be modified, or some or all of the technical features can be equivalently replaced. And these modifications or replacements do not deviate the essence of the corresponding technical solutions from the scope of the technical solutions of the embodiments of the present disclosure, which should be included in the scope of the claims and the description of the present disclosure.

We claim:

1. A handle capable of holding items comprising:

a handle body made of hard material to provide sufficient support force so that the handle body is capable of holding items without deformation; the handle body is connected to a carrier;

at least one carrying notch provided on the handle body;

the carrying notch has a width to hold or support the items;

the handle further comprises a rotary connection device, the handle body is connected to the carrier through the rotary connection device; the rotary connection device comprises: a rotary shaft, the rotary shaft is provided on the carrier or the handle body; the handle body is rotatably connected to the carrier through the rotary shaft; a limiting device, the limiting device is provided on the carrier or the handle body; the limiting device is used to limit the rotation angle of the handle body;

the limiting device comprises: a limiting protrusion provided on the carrier and a limiting engagement surface provided on the handle body for matching with the limiting protrusion; or, a limiting protrusion provided on the handle body and a limiting engagement surface provided on the carrier for matching with the limiting protrusion; when the handle body is rotated to a predetermined position, the limiting protrusion comes into contact with the limiting engagement surface, restricting the handle body from further rotation;

the protrusion is a prism; the prism has a trapezoidal base or a triangular base, and a cross section of the prism parallel to the trapezoidal base or the triangular base is a trapezoid or triangle.

2. The handle capable of holding items according to claim 1, wherein the at least one carrying notch is provided on both sides of the handle body.

3. The handle capable of holding items, according to claim 1, wherein a width of the at least one carrying notch is 0.5-3 cm.

4. A cover, the cover comprising a handle capable of holding items according to claim 1.

5. A cup, the cup comprising the cover according to the claim 4.

6. A cup, the cup comprising a handle of claim 1.

* * * * *